United States Patent [19]

Gorsuch et al.

[11] 4,265,213

[45] May 5, 1981

[54] FREE STANDING STOVE

[76] Inventors: Garald W. Gorsuch, Rte. 3, Box 292, Sherwood, Oreg. 97140; Eldon D. Schnelle, 19501 S. McVey La., Oregon City, Oreg. 97045

[21] Appl. No.: 933,890

[22] Filed: Aug. 15, 1978

[51] Int. Cl.[3] ..... F24B 7/04

[52] U.S. Cl. ..... 126/66; 126/67; 126/77; 220/DIG. 25

[58] Field of Search ..... 220/DIG. 25; 126/120, 126/121, 123, 126, 61, 63, 67, 62, 66, 72, 73, 135, 136, 163 R, 163 A, 193, 77

[56] References Cited

U.S. PATENT DOCUMENTS

| | | | |
|---|---|---|---|
| 285,399 | 9/1883 | Dodst | 126/77 |
| 685,194 | 10/1901 | Yonng | 126/66 |
| 717,290 | 12/1902 | Shafer | 126/66 |
| 844,292 | 2/1907 | Thurston | 126/77 |
| 1,136,615 | 4/1915 | Rice | 126/77 |
| 1,200,577 | 10/1916 | Berkheimer | 126/77 |
| 1,607,312 | 11/1926 | Schierenbeck | 126/163 R X |
| 1,674,379 | 6/1978 | Taliaferro . | |
| 1,770,339 | 7/1930 | Lake | 126/295 X |
| 2,114,772 | 4/1938 | Althoff | 126/77 |
| 2,302,197 | 11/1942 | Edwards . | |
| 2,358,044 | 9/1944 | Barnes | 126/193 |
| 3,096,754 | 7/1963 | Howrey | 126/120 |
| 3,926,174 | 12/1975 | Bell | 126/121 |
| 4,068,649 | 1/1978 | Johnson | 126/120 |
| 4,121,560 | 10/1978 | Knight | 126/121 X |
| 4,121,561 | 10/1978 | Cote | 220/DIG. 25 |
| 4,131,105 | 12/1978 | Moncrieff-Yeates | 126/121 |
| 4,141,336 | 2/1979 | Fitch | 126/121 |
| 4,150,658 | 4/1979 | Woods | 126/72 |

FOREIGN PATENT DOCUMENTS

| | | | |
|---|---|---|---|
| 900982 | 7/1945 | France | 126/77 |

*Primary Examiner*—Allan N. Shoap
*Attorney, Agent, or Firm*—Klarquist, Sparkman, Campbell, Leigh, Whinston & Dellett

[57] ABSTRACT

A stove comprises a firebox formed of two U-shaped interfitting members of steel plate and a U-shapted one piece base. Dual primary and secondary draft air channels extend along the bottom of the firebox from front to back immediately underneath the fire and upwardly at the rear of the firebox. A first or larger channel provides primary combustion air to the fire and the second channel extends farther upwardly to the region where volatile gases would enter the flue to secure more complete combustion thereof. The dual draft channels are controlled by an automatic draft device at the front of the stove through which the draft air is introduced. A heat shield at the rear of the stove cooperates with the one piece base for delivering heated air forwardly to the living area in front of the stove.

2 Claims, 6 Drawing Figures

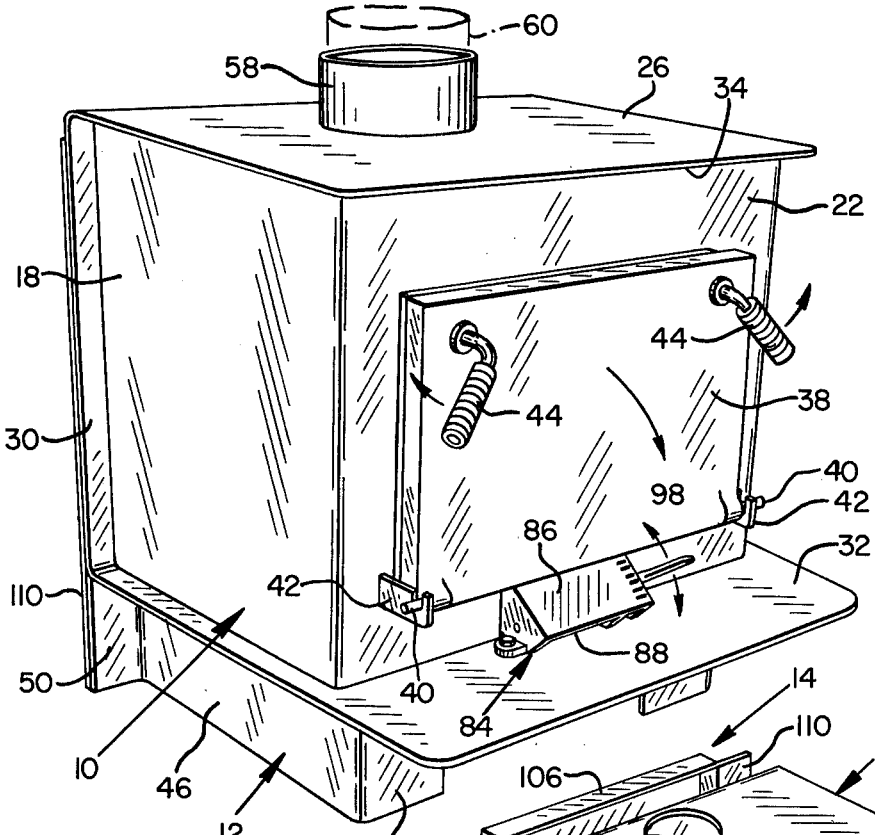
FIG. 1
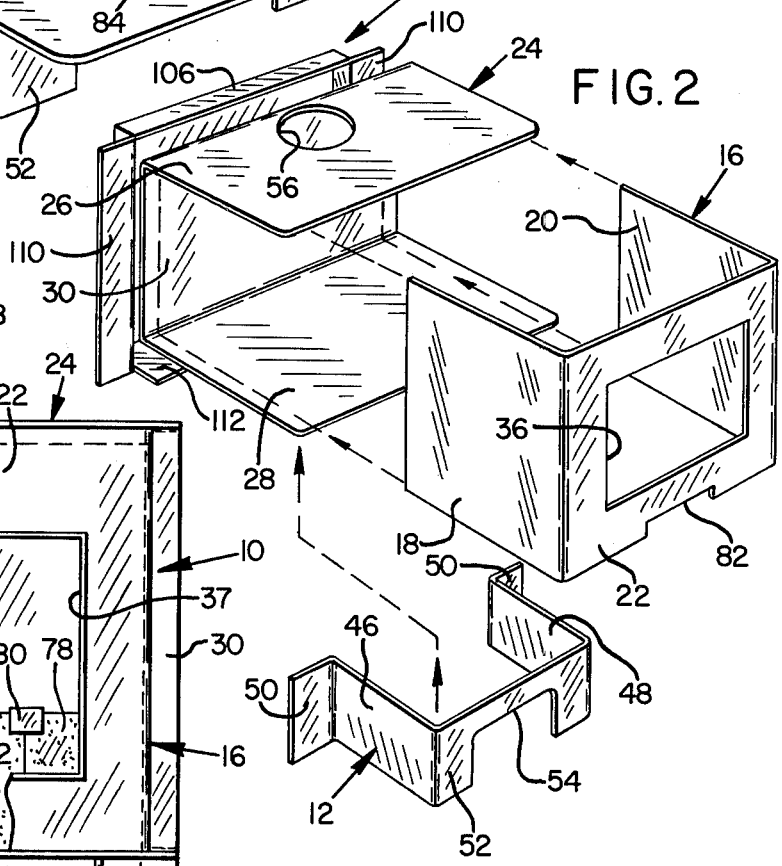
FIG. 2
FIG. 3
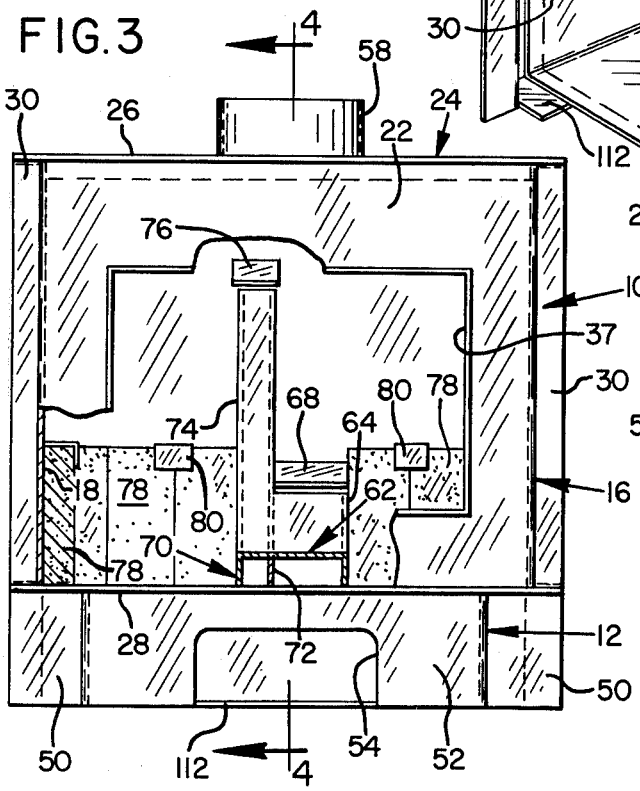

FREE STANDING STOVE

BACKGROUND OF THE INVENTION

The present invention relates to a free standing stove and particularly to such a stove exhibiting increased efficiency and economy of construction.

Wood burning stoves and heaters are enjoying a revival in popularity due to the increasing expense and possible shortage of other fuels. Conventional fireplaces, although attractive, are very inefficient and are not usually adapted for use other than somewhat ineffective area heating. Furthermore, they cannot be conveniently controlled or regulated as to heat level or rate of burning. Free standing or Franklin type stoves have the advantage of greater heat utilization while providing some of the attractiveness of a fireplace open fire. However, many stoves of this general type are either inefficient or relatively complicated in construction. Some have controlled draft systems for enhancing the efficiency and regulation of a fire. It is thus possible to preheat the draft air for increasing efficiency to an extent, e.g. by providing a draft channel along a stove wall or otherwise in close proximity to the stove. A controlled slow burning fire can then be maintained for a relatively long period of time without fire cooling by the draft air. Secondary draft air could also be provided for burning of noncombusted gases which might otherwise escape up the flue. However, prior draft systems are apt to be somewhat complex, or may be exterior to the stove. Moreover, not only is heating of primary draft air sometimes less than desired, but also secondary draft air for burning volatile gases is not usually heated to a great extent.

Furthermore, prior stoves are apt to be relatively expensive in construction involving numbers of component parts, and at the same time do not necessarily retain the clean lines or decorator advantages of a conventional fireplace. Also, the room heating possibilities of a stove are not often utilized other than simply by radiation to the surroundings.

SUMMARY OF THE INVENTION

In accordance with the present invention, the efficiency of a free standing stove is increased by provision of a combustion air duct extending along the bottom of the stove through the firebox, and substantially through the area of the fire in said firebox, upwardly proximate the opposite wall of the firebox to an opening near the base of the stove at approximately the level of the fire. The draft air is heated to a considerable extent for enhancing the efficiency of combustion. A draft control, which may be semi-automatic, is advantageously located at the air duct inlet at the front of the stove. A second air duct is desirably positioned along the first but extends to a higher level to provide an outlet supplying preheated secondary air for enhancing combustion of volatile gases that would otherwise escape up the flue.

In accordance with another feature of the present invention, the stove is preferably constructed having a two-piece firebox formed of two interfitting U-shaped steel plate members joined in a welded construction. One of the members desirably extends forwardly of the front of the stove to provide a hearth. The stove can be supported on a one-piece base.

According to a further feature of the present invention, the stove advantageously includes a heat shield secured rearwardly thereof and cooperating with the one-piece base to provide a heating channel for directing heated air downwardly and forwardly of the stove into the surrounding room. A blower is suitably joined to the heat shield for supplying air to the heating channel.

It is accordingly an object of the present invention to provide an improved free standing stove of enhanced efficiency.

It is another object of the present invention to provide an improved free standing stove of simple, safe and internally integrated construction.

It is another object of the present invention to provide an improved attractive free standing stove which is economical in construction and use.

It is another object of the present invention to provide an improved free standing stove adapted for providing optimum utilization of stove heat for room heating.

It is a further object of the present invention to provide an improved free standing stove which is efficient in operation, and which may also be converted to conventional fireplace type use.

It is another object of the present invention to provide an improved free standing stove which supplies all purpose needs for a heating and cooking facility.

The subject matter which we regard as our invention is particularly pointed out and distinctly claimed in the concluding portion of this specification. The invention, however, both as to organization and method of operation, together with further advantages and objects thereof, may best be understood by reference to the following description taken in connection with the accompanying drawings wherein like reference characters refer to like elements.

DRAWINGS

FIG. 1 is a perspective view of a stove according to the present invention;

FIG. 2 is an exploded view of the stove according to the present invention, illustrating principal component parts thereof;

FIG. 3 is a partially broken away front view of the aforementioned stove;

DETAILED DESCRIPTION

Figure 4:
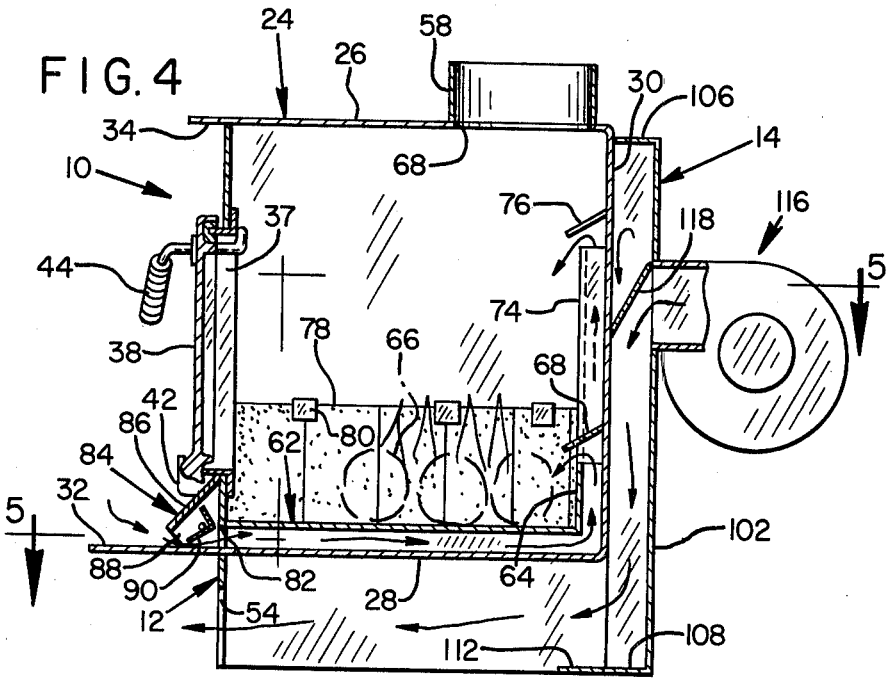
FIG. 4 is a cross-sectional view taken at 4—4 of FIG. 3.

Referring to the drawings and particularly FIGS. 1 through 3, a stove according to the present invention includes a firebox 10 mounted on a base 12 and suitably having a heat shield 14 joined rearwardly to the firebox and the base. The firebox is formed from two U-shaped steel plate members, i.e. a first U-shaped member 16 forming the lateral sides 18 and 20 and a front wall 22 of the firebox, and a second U-shaped member 24 forming the top wall 26, the bottom wall 28, and the rear wall 30 of the firebox. These U-shaped members comprise steel plates bent to the U-shape indicated and welded together in interlocking relationship. Thus, the U-shaped members are joined in inverted relationship to one another and turned 90° with respect to an axis bisecting the "bottom" of each U-shape. The members are welded together along the dashed lines indicated in side member 24 in FIG. 2 to form a substantially closed firebox with the bottom wall 28 extending forwardly of front wall 22 to provide a hearth plate 32. In general, the dimensions of the walls of member 24 extend outwardly farther than corresponding walls of member 16 to provide an upper flange edge 34 above the front wall, as well as side recesses adjacent the side walls 18 and 20. Of course, the height of rear wall 30 matches the height of side walls 18 and 20 such that member 16 is closely received within member 24 for providing the enclosure.

Front wall 22 has a rectangular forward opening 36 receiving a door frame 37 for door 38. Door 38 is rotatable upon side pins 40 received in vertical slots located in forwardly directed brackets 42 which are positioned adjacent the lower left and right corners of the door frame. Door 38 is provided with conventional handles 44 near the upper left and right-hand corners thereof which engage the edge of the door frame to secure the door in place. The door can be opened to a horizontal position when these handles are disengaged, and can be entirely removed by sliding the door including pins 40 upwardly with respect to the slots in brackets 42. The stove can then be utilized as an open fireplace, and a fire screen may be substituted for door 38 and received in the slots in brackets 42 if so desired.

The top wall 26 of member 24 is provided with a round hole 56 near the central rear thereof around which a cylindrical exhaust boot 58 is welded or otherwise secured. The exhaust boot 58 receives flue pipe 60 through which exhaust gases escape.

The base 12, which is also U-shaped and formed of steel plate, is welded to the underside of bottom wall 28. Base 12 includes left and right side walls 46 and 48 ending in outwardly directed flanges 50 positionable approximately in line with the rear wall 30 of the firebox. Forward wall 52 of the base includes an opening 54 for communicating to the region underneath the firebox and to the enclosure of heat shield 14 at the rear of the firebox when a heat shield is employed. Except for opening 54, it will be seen the underside of the stove is substantially enclosed by base 12, heat shield 14 and the floor or other surface upon which the stove rests. The stove basically comprises three pieces, i.e. members 16 and 24 forming the firebox and base 12 thereunder, while heat shield 14 is optional.

Figure 5:
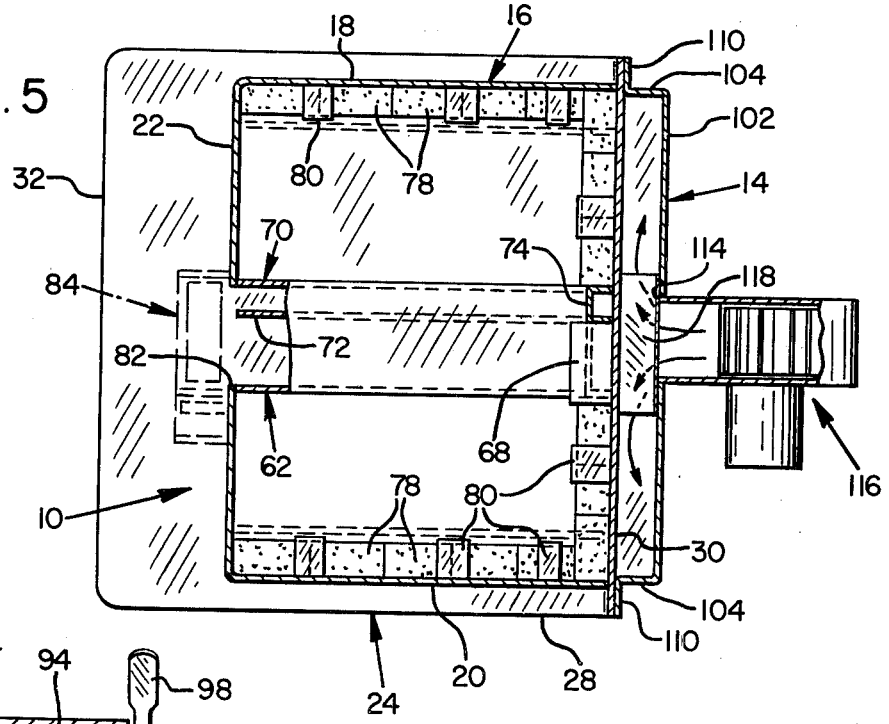
FIG. 5 is a cross-sectional view taken along the line 5—5 of FIG. 4.

Referring now particularly to FIGS. 3, 4 and 5, it will be seen the stove according to the present invention includes a draft duct system for preheating combustion air for the fire in the firebox. A parallel duct structure includes a first duct 62 of horizontal cross section extending across bottom wall 28 from the front portion of the stove to the rear portion of the stove. The duct is open on its forward end to receive draft air, and extends rearwardly upwardly proximate rear wall 30 as indicated at 64 in the drawings to a point approximately horizontally adjacent the fire 66 within the firebox where the duct opens to supply combustion air to the fire. A draft deflector 68 is located immediately above the opening but spaced upwardly therefrom and is secured to the rear wall 30 or to the duct for deflecting the combustion air horizontally or downwardly toward the fire.

A second duct 70, also of horizontal cross section, extends in parallel relation to the first duct and suitably comprises a part of the same metal structure having a common wall 72 with the first duct. Duct 70 is thus open at its forward end and extends horizontally over bottom wall 28 to a location proximate rear wall 30, and then runs upwardly as indicated at 74 to a point substantially higher up the rear wall than the rear opening of duct 62. Thus, upward extension 64 of duct 62 provides an outlet in approximate horizontal registration with the fire 66. However, upward extension 74 of duct 72 terminates with an opening nearly three-fourths the way up the back of the firebox and provides combustion air for secondary combustion of volatile gases that would otherwise escape up the flue uncombusted. A draft deflector 76 is secured to the rear wall 30 or to the second duct for directing air horizontally outwardly and downwardly in the area inside the firebox immediately below exhaust boot 58 for insuring better combustion in this area.

The ducts 62 and 70 extend immediately under the fire 66 and along the rearward edge thereof whereby the combustion air is well preheated for enhancing the efficiency of the combustion process. The duct structure 62, 70 is formed of steel plate suitably as thick as the steel plate from which the firebox is formed, e.g. 3/16" plate. The rectangular cross-sectional area of duct 62 is desirably larger than the cross-sectional area of duct 70 whereby to supply sufficient primary combustion air to the fire. In the specific example, the cross-sectional area of duct 72 is nearly two and one-half times the cross-sectional area of duct 70. As can be seen, the ducts 62 and 70 run below and substantially through the fire 66 in the firebox, but is desired, firebricks may be positioned on the bottom wall 28 on either side of the duct structure, but not covering the same. Similarly, firebricks as indicated at 78, may be utilized to line the sides of the firebox. If desired a grate, indicated at 80 in FIG. 4, may be employed across the firebox and the fire located on top thereof. In such case, duct 62 will provide draft air underneath the fire and through the fire, while duct 70 will again provide combustion air for secondary combustion of volatile gases above the fire.

Figure 6:
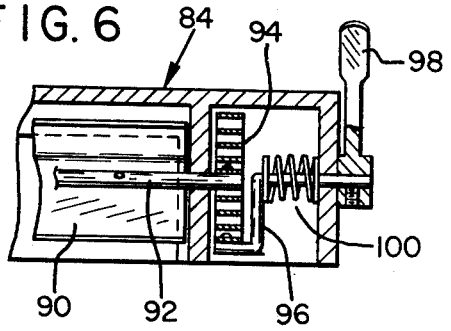
FIG. 6 is a detailed view, partially broken away in cross section, of a damper control for the stove according to the present invention.

Ducts 62, 70 terminate in a matching opening 82 in the lower front wall of the firebox adjacent bottom wall 28. A draft control housing 84 closes opening 82 from the front and is secured to front wall 22 of the firebox and is supported above hearth plate 32. Draft control housing 84 has a downwardly slanting forward wall 86 concluding in a horizontal front opening 88 through which the combustion gases enter. Within the draft control housing is located a substantially horizontally extending L-shaped damper plate 90 which pivots about a horizontal axis partially to close off opening 82 and thereby regulate the amount of draft air flowing in ducts 62 and 70. Referring particularly to the detailed cross-sectional view of FIG. 6, it is noted damper plate 90 is mounted for rotation with horizontal shaft 92 centrally driven by bimetallic temperature-activated coil 94 having its outer end connected to crank arm 96. Crank arm 96 is in turn rotatable from control lever 98 positioned outside the housing 84. A spring 100 holds the lever 98 in position by exerting pressure respectively on the crank arm and the inside of the housing 84. As viewed in FIG. 1, downward movement on lever 98 tends to close off the draft and reduce combustion air, while upward movement tends to produce a greater flow of combustion air. The crank arm is utilized to select the temperature range of operation for the stove, and the bimetallic coil 94 maintains the desired temperature level. As the temperature increases, the damper plate 90 is rotated for reducing the draft, while if the temperature tends to drop from the selected level, the damper plate will rotate in the opposite direction.

For many purposes, a complete stove is formed from substantially only three major structural pieces, i.e., members 16 and 24, and base 12. However, for enhanced room heating the stove is advantageously supplied with heat shield 14 also formed of steel plate and which can be bolted, welded or otherwise secured to the rear surface of back wall 30. The heat shield substantially encloses the back wall and comprises a box structure including a rear plate 102 parallel to back wall 30, vertical side walls 104, top 106 positioned just above top wall 26 of the stove, and bottom 108 which rests upon the floor or other surface upon which the main stove is supported. The heat shield is open in front such that rear wall 30 of the stove completes its enclosure, with side wall flanges 110 bent for securing, as by bolting, to the rear wall 30 where the latter extends just beyond the firebox, and to flanges 50 of the base. The bottom end 108 of the heat shield is desirably extended as a forward flange 112 for fitting under the base 12 of the stove where the latter is open from the rear.

The back plate 102 of the heat shield if provided with a hole 114 about three-fourths the way up its vertical dimension for receiving the outlet duct of a conventional blower 116 mounted on the heat shield. A deflector 118 which may be short in the horizontal direction, is diagonally positioned for extending from approximately the upper edge of opening 114 and downwardly toward the back wall 30 of the stove, whereby air impelled through opening 114 by the blower is deflected mainly downwardly along the back wall 30 of the firebox. Since the base 12 of the stove is open rearwardly and the heat shield 14 extends to the floor and is open forwardly, the air is further driven by blower 116 from under the stove to exit via opening 54 in the front of the stove base. It will be appreciated both the back wall of the stove and the underside thereof are relatively high in temperature but radiate heat in directions not always affording the greatest heat exchange to the surrounding room. The heat shield delivers the heated air forwardly of the stove and increases the efficiency thereof for room heating, while at the same time tending to lower the temperature at the back and underneath stove areas for greater safety, for example, with respect to a building wall rearward of the stove. There is thus provided an attachment for the stove which enhances the utilization and efficiency thereof as a space heater.

The stove has been found to be quite efficient in operation and heat utilization while being usable for heating, cooking, or as an attractive fireplace when it is desired to remove the door 38. The stove is simple, sturdy and economical in construction utilizing a minimal number of separate component parts.

While we have shown and described a preferred embodiment of our invention, it will be apparent to those skilled in the art that many changes and modifications may be made without departing from our invention in its broader aspects. We therefore intend the appended claims to cover all such changes and modifications as fall within the true spirit and scope of our invention.

We claim:

1. A stove adapted for location in spaced relation to a wall of a room, said stove comprising:

a metal firebox comprising spaced metal side walls, a top, and a bottom wall forming a substantially closed enclosure for supporting fuel therewithin above the bottom wall of said firebox, a flue connection opening for removing flue gases from said firebox, a door providing access to said firebox for the deposition of fuel therewithin, and base means for supporting said firebox, said firebox including a first U-shaped member and a second U-shaped member, wherein said U-shaped members are joined in inverted ninety degree relationship such that one member forms a closure with the other to provide said firebox, wherein said first U-shaped member forms the side walls including the front of said stove, said front having a door opening provided with said door, and said second U-shaped member forms the top, bottom wall and rear wall of said stove, said base means extending downwardly from the bottom wall of the second U-shaped member of said firebox, further including a first air duct extending along the bottom wall of said second member from a first end in communication with an opening in the front of said first U-shaped member for receiving draft air and upwardly adjacent the rear wall of said second member to a second end horizontally adjacent the position of the fire in said firebox, said first duct being closed except for a first opening on the first end thereof extending through said front of said first member and a second opening at said second end for providing draft air to the fire in said firebox, a second air duct extending along the bottom wall of said second member from a first end in communication with an opening in the front of said first member and upwardly adjacent the rear wall of said second member to a second end above the level of the fire in said firebox, said second duct being closed except for an opening at the first end thereof extending through said front of said first member for receiving draft air and a second opening at the second end thereof for providing secondary air for combustion of volatile gases above the location of a fire in said firebox, and a damper adjacent the first ends of said first duct and said second duct for regulating the flow of draft air therethrough.

2. The stove according to claim 1 further including a heat shield extending at least along and enclosing the outside of the rear wall of said second member, and fan means mounted for forcing air vertically downward through said heat shield, and an opening from underneath the base means of said stove from which heated air is impelled by said fan means for providing heated air to the surroundings.

* * * * *